US006292646B1

(12) United States Patent
Maul et al.

(10) Patent No.: US 6,292,646 B1
(45) Date of Patent: Sep. 18, 2001

(54) ANTI-UNRAVELING DEVICE FOR A FUSER OIL SUPPLY WEB

(75) Inventors: Michael David Maul; Edward Alan Rush, both of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/419,689

(22) Filed: Oct. 14, 1999

(51) Int. Cl.[7] ..... G03G 15/20
(52) U.S. Cl. ..... 399/325
(58) Field of Search ..... 399/324, 325–327, 399/352; 242/538, 538.1, 554.5, 343

(56) References Cited

U.S. PATENT DOCUMENTS

| | | | | |
|---|---|---|---|---|
| 3,740,864 | * | 6/1973 | Ito et al. | 399/352 |
| 4,875,063 | | 10/1989 | Idenawa et al. . | |
| 5,156,350 | | 10/1992 | Wales et al. . | |
| 5,293,202 | | 3/1994 | Adachi et al. . | |
| 5,344,089 | | 9/1994 | Crowley et al. . | |
| 5,472,153 | | 12/1995 | Crowley et al. . | |
| 5,505,401 | | 4/1996 | Lamothe . | |
| 5,530,528 | | 6/1996 | Houki et al. . | |
| 5,617,134 | | 4/1997 | Lamothe . | |
| 5,651,511 | | 7/1997 | Crowley et al. . | |
| 5,768,675 | | 6/1998 | Estabrooks . | |
| 5,848,341 | * | 12/1998 | Watanabe | 399/352 |
| 6,006,063 | * | 12/1999 | Shimizu et al. | 399/325 |

* cited by examiner

*Primary Examiner*—William J. Royer
(74) *Attorney, Agent, or Firm*—Michael T. Sanderson

(57) ABSTRACT

An apparatus and method are provided for preventing unraveling of an oil supply web by the selective application of a locking mechanism to a web supply roller when a fuser hot roller or other fuser drive roller is forced to rotate in a reverse rotation. The locking mechanism is released when the fuser hot roller resumes normal rotation. A pivoting arm is adapted for pivotal movement into locking engagement with the web supply roller. A braking element, such as a ratchet latch, attached to the end of the pivoting arm, or pawl, contacts a rotary follower or other rotational member connected to and operable to prevent rotation of the web supply roller. The braking element is disengaged when the fuser hot roller resumes rotation in the normal direction, as the pawl is pivoted out of engagement with the rotary follower. In this manner, the web operates to lubricate and condition the fuser hot roller from controlled rotation of the web supply roller when the fuser hot roller is rotating in the normal direction, and is prevented from unraveling when the fuser hot roller is rotated in a reverse direction.

32 Claims, 7 Drawing Sheets

ANTI-UNRAVELING DEVICE FOR A FUSER OIL SUPPLY WEB

BACKGROUND OF THE INVENTION

Silicone oil supply webs are known which provide a release agent to a fuser in an electrophotographic process such as that used in electrophotographic printers. Such printers produce hardcopy images on paper or other print media through precise deposition of toner onto the paper. The toner is adhered to the paper by a fuser hot roller, which heats and melts the toner to fuse it to the paper. As the toner melts, it becomes tacky and has a tendency to adhere to the fuser hot roller. Over time, accumulated toner can compromise the print process. Application of a lubricating substance such as silicone oil to the fuser hot roller serves to prevent adhesion of the toner, and also smooths the toner surface on the paper. An oil supply web provides a controlled supply of silicone oil to a fuser hot roller during the print process.

Referring to prior art FIG. 1, an oil supply web 10 is a sheet of fibrous or membrane material held against the fuser hot roller 18 by an idling bias roller 20. The web is wrapped around a supply roller 12 and a take-up roller 14. Oil delivery is controlled by indexing the take-up and supply rollers 14, 12 as the web is held against the fuser hot roller by the bias roller 20. As the web 10 is fed in a direction opposite to the rotation of the fuser hot roller, abrasive and frictional forces clean the fuser hot roller 18. Since the fuser hot roller 18 rotates in a direction opposite to the web 10, the web remains taut between the idling bias roller 20 and the take-up roller 14. Concurrently, silicone oil absorbed or embedded in the web is applied onto the fuser hot roller upon contact therewith as the paper 22 advances. A controlled supply of oil is therefore provided to the fuser hot roller as the web advances from the supply roller 12 to the take-up roller 14.

The oil supply web 10, however, can become unraveled when the fuser hot roller is rotated in a reverse direction. Reverse rotation can result from attempts 1o clear paper jams. Referring to prior art FIG. 2, reverse rotation can occur from a user removing paper 24 in the direction of arrow 26, or from rotation of a jam-clearing knob 28. Frictional contact between the web and the fuser hot roller due to the idling bias roller 20 occurs as the fuser hot roller 18 rotates in the reverse direction. Such reverse rotation causes the web 10 to unravel from the supply roller 12 into the jam zone 30. Unraveling of the web causes the web material to jam, decreases the web supply lifetime, and can also cause further problems if excess oil leaks onto other parts.

It would be beneficial, therefore, to provide an apparatus which prevents the oil supply web from unraveling when the fuser hot roller is rotated in a reverse direction, yet which does not hinder the rotation of the fuser hot roller in the normal direction, so as to allow both normal or jam-clearing hot roller rotation without compromising the oil supply web.

BRIEF SUMMARY OF THE INVENTION

An apparatus and method are provided for preventing unraveling of an oil supply web by the selective application of a locking mechanism to a web supply roller when a fuser hot roller or other fuser drive roller is forced to rotate in a reverse rotation. The locking mechanism is released when the fuser hot roller resumes normal rotation.

A pawl arm is adapted for pivotal movement into locking engagement with the web supply roller. A braking element, such as a ratchet latch attached to the end of the pawl arm, contacts a rotary follower connected to the web supply roller. The braking element is disengaged when the fuser hot roller resumes rotation in the normal direction, as the pawl arm is pivoted out of engagement with the rotary follower. In this manner, the web operates to lubricate and condition the fuser hot roller from controlled rotation of the web supply roller when the fuser hot roller is rotating in the normal direction, and is prevented from unraveling when the fuser hot roller is rotated in a reverse direction.

Selective rotational communication between the fuser hot roller and the pawl arm transfers rotational force to the pawl arm when the fuser hot roller changes direction. Rotational communication is maintained until the pawl reaches a predetermined point of engagement or disengagement with the web supply roller, depending on whether the fuser hot roller is rotating in the normal or reverse direction, respectively. When the pawl arm has reached such a predetermined point, slippable communication between the fuser hot roller and the pawl arm is resumed to maintain a slight drag on the pawl so as to maintain the position of the pawl in the engaged or disengaged position.

BRIEF DESCRIPTION OF THE SEVERAL VIEWS OF THE DRAWING

The invention as disclosed herein will be more fully understood with reference to the following detailed description and drawings, of which.

DETAILED DESCRIPTION OF THE INVENTION

Figure 1:
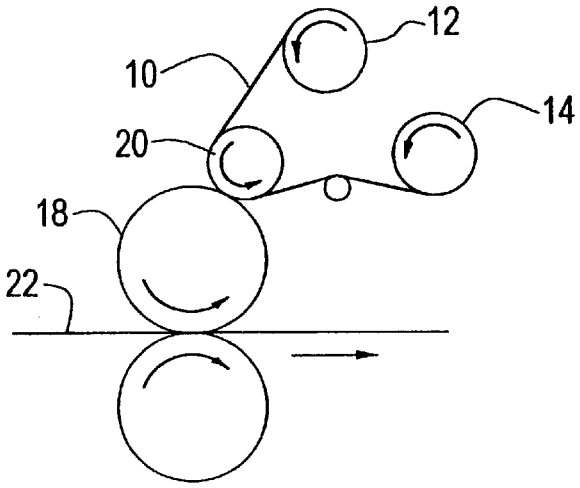
FIG. 1 PRIOR ART
FIG. 1 shows a prior art oil web.
Figure 2:
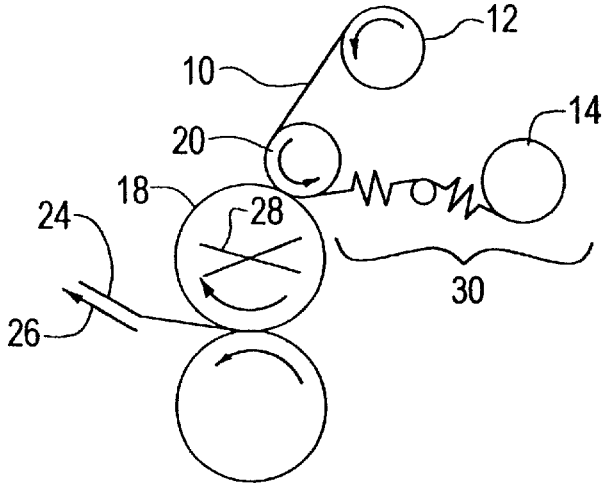
FIG. 2 PRIOR ART
FIG. 2 shows a prior art oil web unraveling jam.
Figure 3:
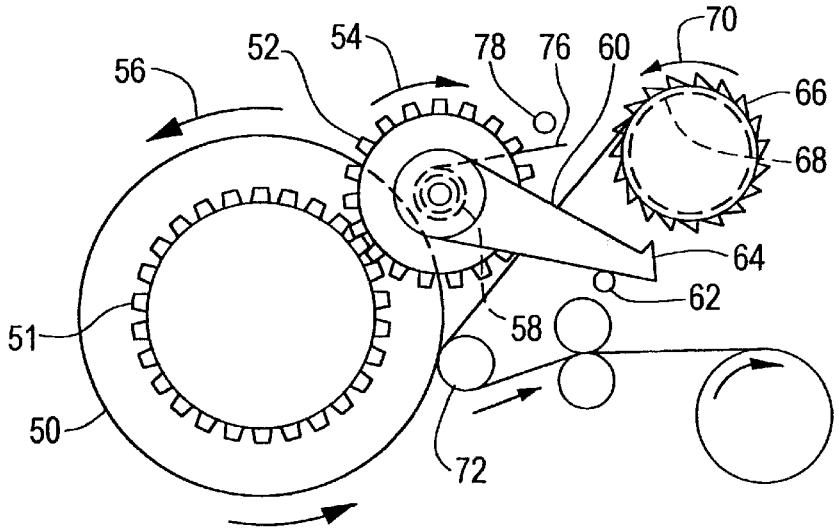
FIG. 3 shows a side view of the anti-unraveling apparatus during normal operation as disclosed herein.

Referring to FIGS. 3–6, the anti-unraveling apparatus as defined by the present invention is shown. During normal fuser hot roller rotation, shown in FIGS. 3 and 5, the fuser hot roller 50 is rotated in the direction of arrow 56 by a fuser drive 53. A fuser hot roller gear 51 is attached to the end of the fuser hot roller 50 and meshes with the fuser drive 53. The fuser hot roller gear also meshes with a pawl gear 52, causing rotation of the pawl gear 52 in the direction of arrow 54. A pawl arm 60 is connected to the pawl gear 52 through a wrap spring assembly 58, described further below. The pawl arm 60 is pivoted by the pawl gear 52 until the pawl arm contacts a pawl stop 62. The wrap spring assembly 58 provides a slippable rotational connection between the pawl gear 52 and the pawl arm 60. This slippable connection allows the pawl gear 52 to continue rotating with the fuser hot roller gear 51 while providing a slight drag on the pawl arm 60 to bias the pawl against the pawl stop 62. Web supply roller 68 is therefore permitted to rotate in the direction shown by arrow 70. In this manner, normal web supply operation is provided as the web contacts the fuser hot roller 50 at an idling bias roller 72.

Figure 4:
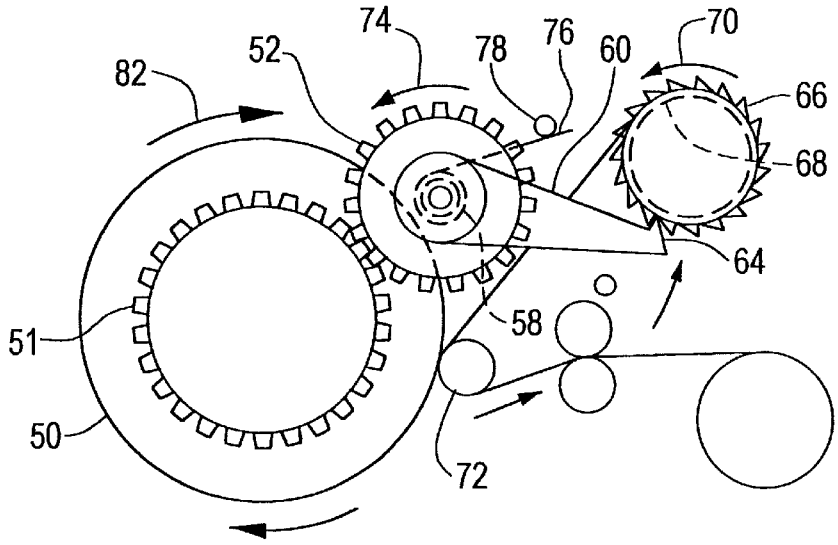
FIG. 4 shows a side view of the anti-unraveling apparatus during anti-unraveling operation as defined herein.
Figure 5:
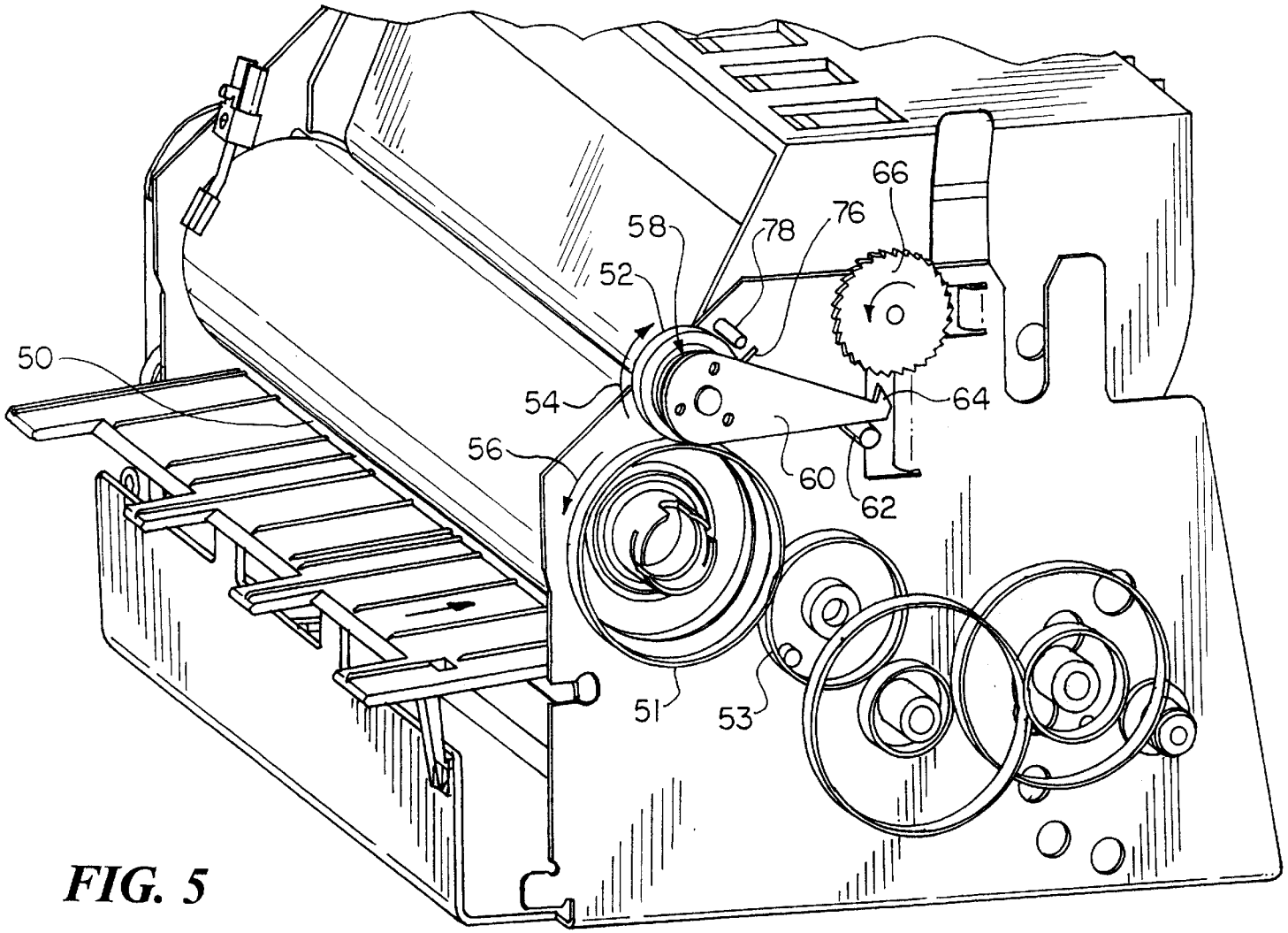
FIG. 5 shows a perspective view of the anti-unraveling apparatus of FIG. 3.
Figure 6:
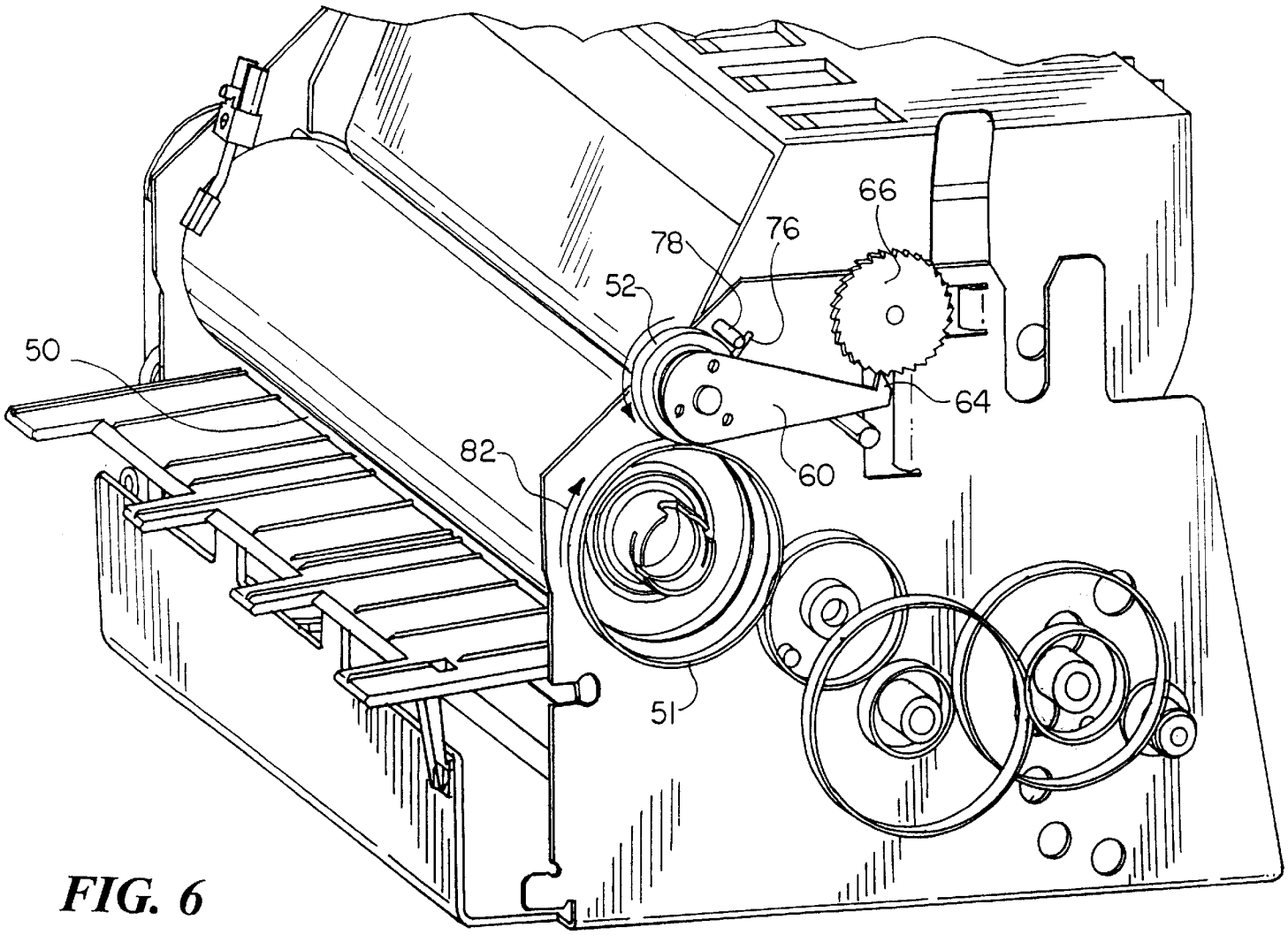
FIG. 6 shows a perspective view of the anti-unraveling apparatus of FIG. 4.

FIGS. 4 and 6 show the operation of the anti-unraveling apparatus preventing reverse rotation of the web supply roller. The fuser hot roller 50 is rotated in the direction shown by arrow 82, which drives the pawl gear 52 in the direction shown by arrow 74. Reverse rotation of the pawl gear 52 causes the wrap spring assembly to engage the pawl arm 60. The pawl arm 60 is pivoted away from pawl stop 62 and toward a web supply ratchet gear 66. The ratchet gear 66 is attached to the end of the supply roller 68, and is operable to stop rotation thereof when engaged by a pawl latch 64, at the end of the pawl arm 60. Reverse rotation in the direction shown by arrow 80 is thus prevented. The wrap spring assembly 58, described below, subsequently maintains a slight drag on the pawl arm 60 which biases the pawl latch 64 against the ratchet gear 66 while permitting the pawl gear 52 to continue to rotate.

The wrap spring assembly 58, shown in FIGS. 7*a*–10*b*, will now be described in more detail. The fundamental theory of operation will first be described. A wrap spring, otherwise known as a spring clutch, is a helical spring 118 that bridges input shaft 120 and output shaft 112, as shown generally in FIG. 7*a*. The input shaft 120 is rotated in the direction of arrow 114. In this direction, friction between the shaft 120 and the spring 118 tends to tighten the spring around the shaft 120, and torque is transferred to the output shaft 112 through the spring. In the reverse direction, however, friction tends to unwind the spring 118 such that the spring overrides the shaft 120 with a slight drag. The amount of drag so provided is dependent on the diameter of the wrap spring 118 and the diameter of the shafts 120 and 112. Friction between the spring and the shafts, therefore, provides a slippable connection such that one shaft may be biased by the other. The wrap spring as defined herein, however, has been adapted to provide selective rotational connection in both directions.

Figure 7A:
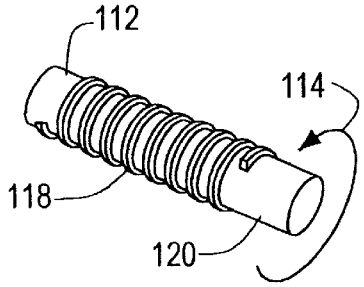
FIG. 7*a* shows a wrap spring.
Figure 7B:
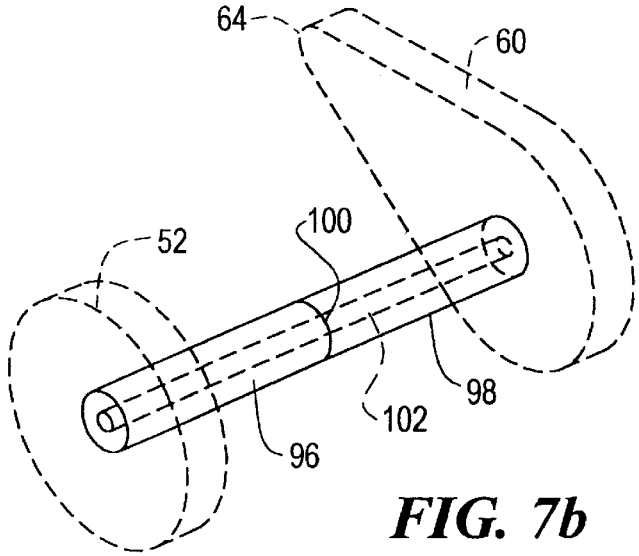
FIG. 7*b* shows the pawl drive and pawl idler arbors.

As indicated above, the wrap spring provides a rotational connection between the pawl arm 60 and pawl gear 52. Referring to FIG. 7*b*, this connection is shown with the wrap spring removed for clarity. A pair of arbors, which are cylindrical members sharing a common shaft and adapted for independent rotation about a common axis, are utilized. A pawl drive arbor 96 having a center bore is attached to the pawl gear 52. A pawl idler arbor 98, also having a center bore, is attached to the pawl arm 60. A pawl shaft 102, is inserted through the center bore in the pawl drive arbor 96 and pawl idler arbor 98. In this manner, the drive gear 52 and the pawl arm 60 are permitted to rotate independently, as the shaft 102 is continuous while the arbors remain discontinuous at separation 100.

Figure 8A:
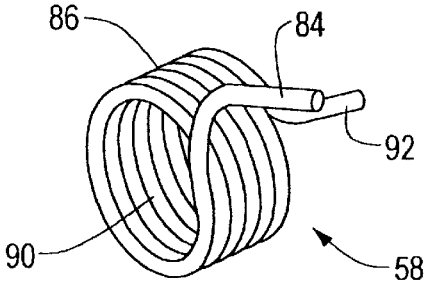
FIGS. 8*a*–8*c* show a wrap spring according to the present invention.
Figure 8C:
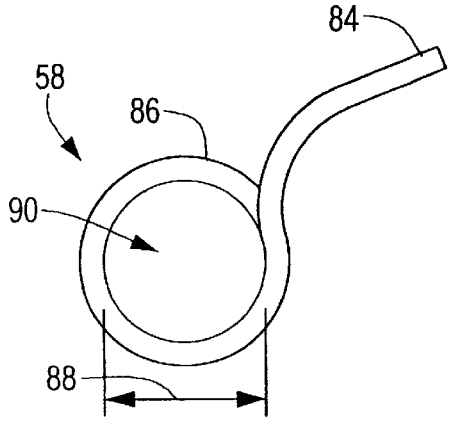
Figure 8B:
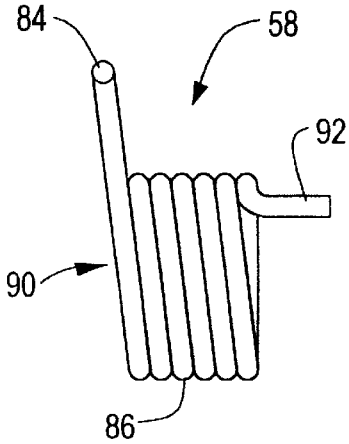

FIGS. 8*a*–8*c* show the wrap spring assembly 58, and FIGS. 9*a*–10*b* show the environment in which the wrap spring is used. A tang 84 is a linear extension of the coiled spring body 86, and allows the diameter of the coiled spring body 86 to be adjusted slightly. An increase in the diameter 88 of the spring allows the pawl drive arbor 96 to slippably rotate inside the spring bore 90. A bent portion 92 is adapted to be received by a wrap spring aperture in the pawl arm 60 to connect the wrap spring to the pawl arm 60, as described further below.

Figure 9B:
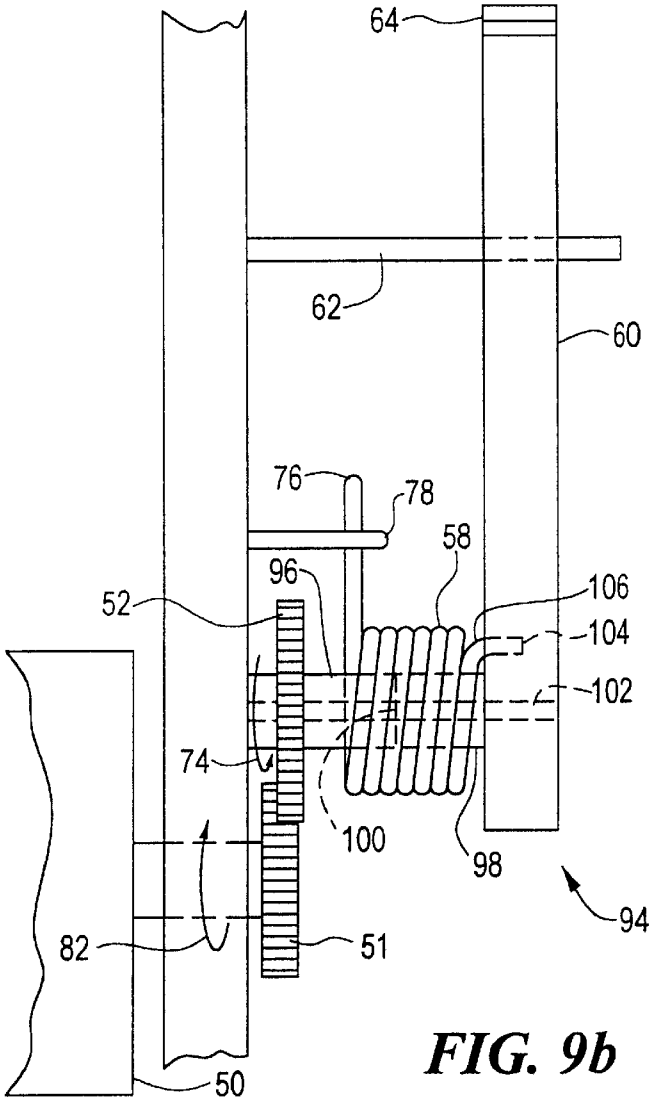
FIG. 9*b* shows a top view of the anti-unraveling apparatus of FIG. 4.
Figure 9A:
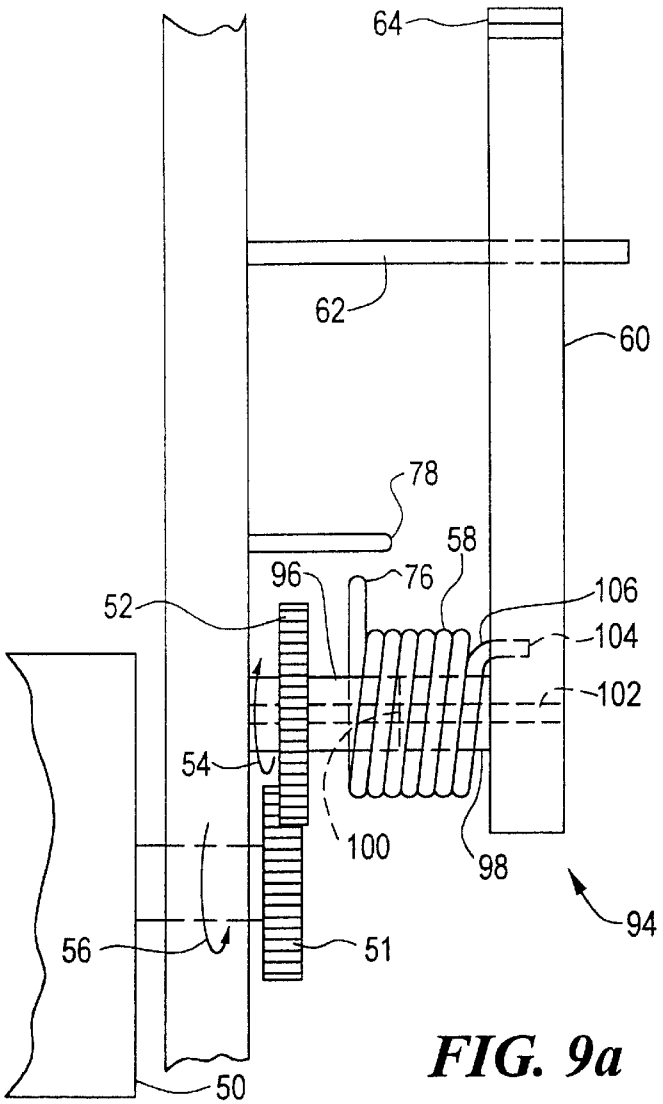
FIG. 9*a* shows a top view of the anti-unraveling apparatus of FIG. 3.
Figure 10A:
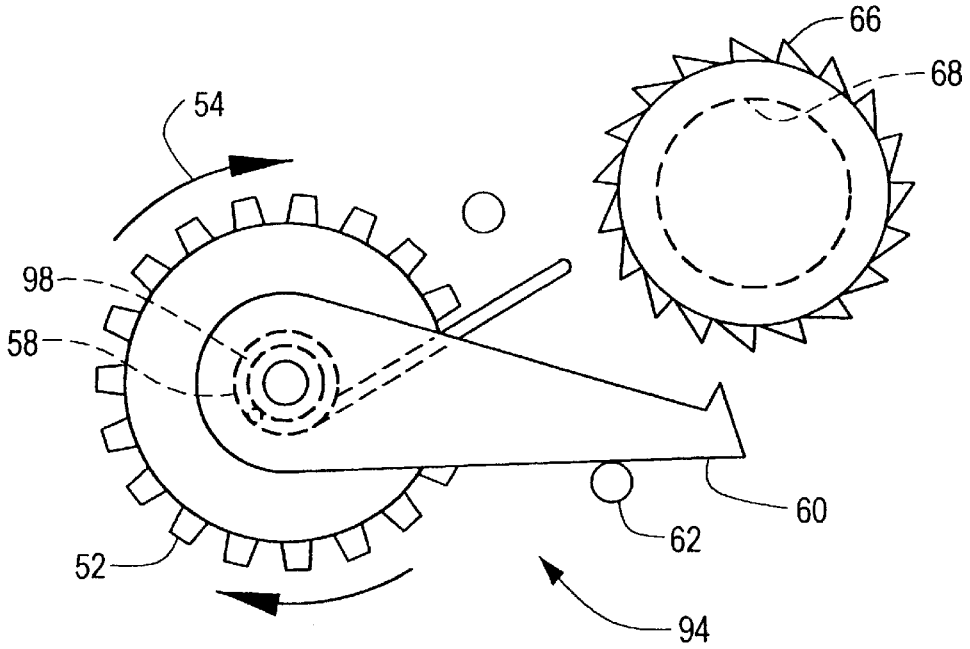
FIG. 10*a* shows a side view of the wrap spring assembly of FIG. 3 in more detail.

Referring to FIGS. 9*a* and 10*a*, the wrap spring assembly 58 is shown during normal rotation of the fuser hot roller 50. As the fuser hot roller rotates, hot roller gear 51 rotates in the direction shown by arrow 56, driving pawl gear 52 in the direction shown by arrow 54. In this direction, the pawl drive arbor 96, in frictional connection with the wrap spring assembly 58 through bore 90 (FIG. 8*a*), rotates the wrap spring. Rotational torque is transferred through the wrap spring assembly 58 to pawl idler arbor 98, also extending through the bore 90 in the wrap spring assembly 58. The spring 58 is further secured to the pawl 60 by a spring aperture 104, into which is inserted the bent portion 92 of the spring 58. The pawl arm 60 is pivoted by rotation of the arbor 98 until the pawl arm 60 contacts the pawl stop 62. At this point, pawl arm 60 and pawl idler arbor 98 are fixed, while pawl drive arbor 96 continues to be rotated by the pawl gear 52. Since the frictional communication between the wrap spring assembly 58 and the pawl drive arbor 96 tends to wind the spring open, the spring diameter is slightly increased until the pawl drive arbor 96 is permitted to slippably rotate inside the spring bore (90, FIG. 8*a*). By maintaining a slight drag on the wrap spring assembly 58 through spring tension, pawl idler arbor 98 and pawl 60 are biased against the pawl stop 62. As the pawl latch is not engaging the ratchet gear, the web supply roller 68 is permitted to rotate freely.

Figure 10B:
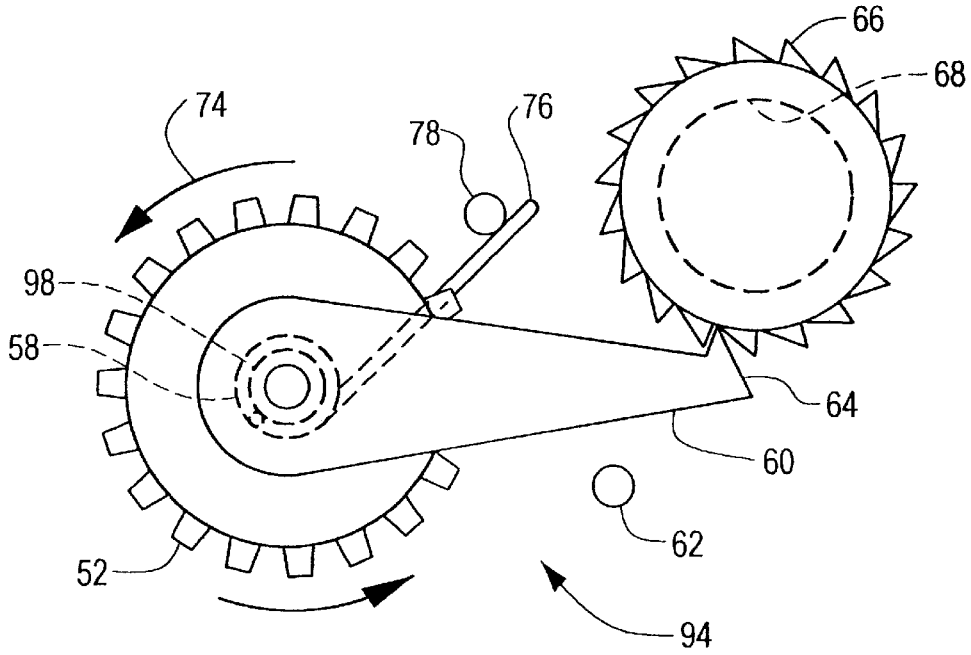
FIG. 10*b* shows a side view of the wrap spring assembly of FIG. 4 in more detail.

Referring to FIGS. 9*b* and 10*b*, wrap spring assembly 58 is shown during reverse fuser hot roller rotation. As the fuser hot roller gear 51 rotates in the direction shown by arrow 82, pawl gear 52 is driven in the direction shown by arrow 74. In this direction, pawl drive arbor 96 rotates in the direction tending to tighten the wrap spring assembly 58 and therefore, decrease the diameter. As the wrap spring tightens, rotational torque is transferred from the drive arbor 96 through the wrap spring assembly 58 to the idler arbor 98. The idler arbor 98 is rotated so as to pivot pawl arm 60 such that pawl latch 64 is disposed towards the web supply ratchet gear 66. As the pawl latch 64 engages the web supply ratchet gear 66, the tang 84 contacts the tang stop 78. At the point where pawl latch 64 is engaged, the tang 84 tends to force the spring into an open position, thereby slightly increasing the inside diameter and allowing pawl drive arbor 96 to slippably rotate inside the spring bore 90 (FIG. 8*a*). The web supply roller 68 is therefore prevented from rotating as the pawl latch 64 is engaged with the web supply ratchet gear 66. The pawl gear 52 and pawl drive arbor 96 are permitted to rotate driven by the fuser hot roller gear 51, thereby allowing reverse rotation of the fuser hot roller 50. A slight drag is maintained against the pawl idler arbor 98 through the spring to bias the pawl arm 60 and pawl latch 64 against the web supply ratchet gear 66. Rotation of the web supply ratchet gear, and therefore advancement of the web supply roller, is prevented while the fuser hot roller continues reverse rotation. When the fuser hot roller resumes rotation in the normal direction, pawl latch 64 is pivoted out of engagement as disclosed above, and the web supply roller 68 is permitted to again rotate freely, allowing the web to provide oil to the fuser hot roller 50.

As various extensions and modifications to the embodiments disclosed herein may be apparent to those skilled in the art, particularly with regard to alternate arrangements of rollers, the present invention is not intended to be limited except by the following claims.

What is claimed is:

1. An anti-unraveling apparatus for an electrophotographic process fuser web supply roller comprising:

a locking mechanism selectively coupled to the fuser web supply roller and operative to permit rotation of said fuser web supply roller in a normal direction and further operative to prevent rotation of said fuser web supply roller in a direction opposite to said normal direction.

2. The anti-unraveling apparatus of claim 1 wherein said locking mechanism further comprises:

a pawl gear in rotational communication with a fuser drive roller and adapted for rotation about a pawl axis;

a pawl drive arbor disposed on said pawl gear for rotation about said pawl axis;

a pawl arm having a pawl idler arbor adapted for pivotal movement about said pawl axis; and a selective coupling between said pawl drive arbor and said pawl idler arbor which allows free movement of said fuser drive roller.

3. The anti-unraveling apparatus of claim 2 wherein said selective coupling further comprises:

a wrap spring disposed around said pawl drive arbor and said pawl idler arbor and adapted to provide selective rotational communication between said pawl drive arbor and said pawl idler arbor, wherein said selective rotational communication pivots said pawl arm into and out of engagement with said fuser web supply roller for stopping rotation thereof.

4. The anti-unraveling apparatus of claim 3 wherein said selective rotational communication comprises pivoting said pawl arm to a first predetermined limit when said fuser drive roller rotates in a first direction, and said selective rotational communication comprises pivoting said pawl arm to a second predetermined limit when said fuser drive roller rotates in a second direction.

5. The anti-unraveling apparatus of claim 4 further including a pawl stop disposed in an intersecting location with said pawl arm, wherein said first predetermined limit is a point at which said pawl arm contacts said pawl stop.

6. The anti-unraveling apparatus of claim 3 further including a tang attached to said wrap spring, said tang comprising a radial extension of said wrap spring adapted to partially unwind said wrap spring.

7. The anti-unraveling apparatus of claim 6 further including a tang stop disposed in an intersecting path with said tang, wherein a second predetermined limit is a point at which said tang contacts said tang stop.

8. The anti-unraveling apparatus of claim 7 wherein said selective rotational communication is rotational connection when said tang is not contacting said tang stop and said selective rotational communication is slippable rotational communication when said tang is contacting said tang stop.

9. The anti-unraveling apparatus of claim 7 wherein said wrap spring partially unwinds when said tang is in contact with said tang stop.

10. The anti-unraveling apparatus of claim 9 wherein said unwinding is such that the inside diameter of said wrap spring is greater than that of said pawl drive arbor.

11. The anti-unraveling apparatus of claim 3 wherein said wrap spring has a diameter and tension such that said selective rotational communication comprises rotationally engaging said pawl drive arbor with said pawl idler arbor when said fuser drive roller is rotating in a first direction and said pawl arm is not disposed at a first predetermined limit, and slippably engaging said pawl drive arbor with said pawl idler arbor when said pawl arm is disposed at said first predetermined limit.

12. The anti-unraveling apparatus of claim 3 wherein said wrap spring has a diameter and tension such that said selective rotational communication comprises rotationally engaging said pawl drive arbor with said pawl idler arbor when said fuser drive roller is rotating in a second direction and said pawl arm is not disposed at a second predetermined limit and slippably engaging said pawl drive arbor with said pawl idler arbor when said fuser drive roller is rotating in said second direction and said pawl arm is disposed at said second predetermined limit.

13. The anti-unraveling apparatus of claim 3 wherein said engagement is with a ratchet axially attached to said fuser web supply roller, and said pawl arm further comprises a pawl latch adapted for engagement with said ratchet.

14. The anti-unraveling apparatus of claim 3 wherein said engagement is with a roller axially attached to said fuser web supply roller and adapted for frictional engagement with said pawl arm.

15. The anti-unraveling apparatus of claim 2 wherein said fuser drive roller is a fuser hot roller.

16. The anti-unraveling apparatus of claim 3 wherein said pawl arm further includes a wrap spring aperture wherein a portion of said wrap spring extends into said aperture.

17. The anti-unraveling apparatus of claim 1 wherein said fuser web supply roller is a fuser hot roller web lubrication supply roller.

18. The anti-unraveling apparatus of claim 1 wherein said fuser web supply roller is a fuser hot roller silicone oil web supply roller.

19. The anti-unraveling apparatus of claim 1 wherein said fuser web supply roller is adapted to store and deliver a web wrapped therearound, wherein said web is adapted exude silicone oil and further adapted to adhere particles and toner.

20. A method of preventing unraveling of a electrophotographic process fuser supply web comprising:

winding said fuser supply web around a fuser supply roller having a rotary follower adapted to control rotation of said fuser supply roller;

rotating a pawl drive arbor through rotational communication with a fuser hot roller;

selectively rotating a pawl idler arbor through communication with said pawl drive arbor;

pivoting a pawl having a pawl latch into a first predetermined position through said selective rotation, wherein said pawl latch is disengaged from said rotary follower;

reversing the rotation of said fuser hot roller; and pivoting said pawl into a second predetermined position through said selectively rotating wherein said pawl latch is engaged with said rotary follower such that said fuser supply roller is prevented from rotating.

21. The method of claim 20 further comprising the steps of further reversing said rotating and pivoting said pawl into said first predetermined position.

22. The method of claim 20 further comprising the steps of alternating said pivoting of said pawl into said first predetermined position and said second predetermined position upon each reversing of said fuser hot roller.

23. The method of claim 20 wherein said rotational communication comprises rotating said pawl drive arbor through a wrap spring.

24. The method of claim 20 wherein said selectively rotating comprises slippably engaging.

25. The method of claim 24 wherein said slipably engaging further comprises winding and unwinding a wrap spring.

26. The method of claim 25 wherein said winding and unwinding further comprises partially winding and unwinding from around said pawl drive arbor and said pawl idler arbor.

27. The method of claim 26 wherein said winding comprises contacting a tang attached to said wrap spring to a non-rotating member.

28. A fuser apparatus for an electrophotographic process comprising:

a fuser hot roller operable to melt and fuse toner to a print medium;

a conditioning web partially wrapped around a fuser web supply roller and a fuser web take-up roller and operable for transport by controlled rotation of said fuser web supply roller and said fuser web take-up roller;

an idling bias roller operable to dispose said conditioning web in frictional communication against said fuser hot roller;

a locking mechanism selectively coupled to the fuser web supply roller and operative to permit rotation of said fuser web supply roller in a normal direction and further operative to prevent rotation of said fuser web supply roller in a direction opposite to said normal direction.

29. The fuser apparatus of claim 28 wherein said conditioning web moves along a path in response to the rotation of said fuser web supply roller.

30. The fuser apparatus of claim 28 wherein said locking mechanism avoids unintended movement of said conditioning web.

31. The fuser apparatus of claim 28 wherein said locking mechanism comprises a pawl and ratchet assembly which is engaged with said fuser web supply roller to prevent reverse rotation of said fuser web supply roller and disengaged to allow normal rotation of said fuser web supply roller.

32. A fuser apparatus for an electrophotographic process comprising:

a fuser hot roller operable to melt and fuse toner onto a print media;

a fuser web supply roller adapted to store and deliver a web to clean and lubricate said fuser hot roller and operable to rotate about a web supply roller axis;

an idling bias roller operable to dispose said web against said fuser hot roller;

a pawl gear in rotational communication with a fuser hot roller and adapted for rotation about a pawl axis;

a pawl drive arbor disposed on said pawl gear for rotation about said pawl axis;

a pawl arm having a pawl idler arbor adapted for pivotal movement about said pawl axis;

a wrap spring disposed around said pawl drive arbor and said pawl idler arbor and adapted to provide selective rotational communication between said pawl drive arbor and said pawl idler arbor, wherein said selective rotational communication pivots said pawl arm into and out of engagement with said fuser web supply roller for stopping rotation thereof.

* * * * *